US007065485B1

(12) United States Patent
Chong-White et al.

(10) Patent No.: US 7,065,485 B1
(45) Date of Patent: Jun. 20, 2006

(54) ENHANCING SPEECH INTELLIGIBILITY USING VARIABLE-RATE TIME-SCALE MODIFICATION

(75) Inventors: Nicola R. Chong-White, Cambridge, MA (US); Richard Vandervoort Cox, New Providence, NJ (US)

(73) Assignee: AT&T Corp, New York, NY (US)

( * ) Notice: Subject to any disclaimer, the term of this patent is extended or adjusted under 35 U.S.C. 154(b) by 782 days.

(21) Appl. No.: 10/042,880

(22) Filed: Jan. 9, 2002

(51) Int. Cl.
*G10L 11/06* (2006.01)
*G10L 19/00* (2006.01)
*G10L 21/00* (2006.01)
*G10L 13/06* (2006.01)

(52) U.S. Cl. ..... 704/208; 704/200.1; 704/203; 704/27; 704/500

(58) Field of Classification Search ..... 704/208, 704/200.1, 203, 209, 218, 225, 267, 500, 704/503; 386/85
See application file for complete search history.

(56) References Cited

U.S. PATENT DOCUMENTS

| | | | | |
|---|---|---|---|---|
| 4,692,941 | A * | 9/1987 | Jacks et al. | 704/260 |
| 4,820,059 | A * | 4/1989 | Miller et al. | 704/254 |
| 4,979,212 | A * | 12/1990 | Yamada et al. | 704/234 |
| 5,327,521 | A * | 7/1994 | Savic et al. | 704/272 |
| 5,553,151 | A * | 9/1996 | Goldberg | 381/312 |
| 5,611,018 | A * | 3/1997 | Tanaka et al. | 704/215 |
| 5,625,749 | A * | 4/1997 | Goldenthal et al. | 704/254 |
| 5,729,658 | A * | 3/1998 | Hou et al. | 704/270 |
| 5,752,222 | A * | 5/1998 | Nishiguchi et al. | 704/201 |
| 5,774,837 | A * | 6/1998 | Yeldener et al. | 704/219 |
| 5,828,995 | A * | 10/1998 | Satyamurti et al. | 358/1.18 |
| 5,864,812 | A * | 1/1999 | Kamai et al. | 704/268 |
| 5,903,655 | A * | 5/1999 | Salmi et al. | 381/321 |
| 6,026,361 | A * | 2/2000 | Hura | 704/270 |
| 6,104,822 | A * | 8/2000 | Melanson et al. | 381/320 |
| 6,233,550 | B1 * | 5/2001 | Gersho et al. | 704/208 |
| 6,285,979 | B1 * | 9/2001 | Ginzburg et al. | 704/208 |
| 6,304,843 | B1 * | 10/2001 | Choi et al. | 704/219 |
| 6,413,098 | B1 * | 7/2002 | Tallal et al. | 434/185 |
| 6,563,931 | B1 * | 5/2003 | Soli et al. | 381/318 |
| 6,691,082 | B1 * | 2/2004 | Aguilar et al. | 704/219 |
| 6,745,155 | B1 * | 6/2004 | Andringa et al. | 702/189 |
| 6,850,577 | B1 * | 2/2005 | Li | 375/326 |
| 2001/0015968 | A1 * | 8/2001 | Sicher et al. | 370/352 |
| 2002/0133332 | A1 * | 9/2002 | Bu et al. | 704/205 |
| 2003/0093282 | A1 * | 5/2003 | Goodwin | 704/500 |
| 2004/0120309 | A1 * | 6/2004 | Kurittu et al. | 370/352 |

OTHER PUBLICATIONS

Sanneck, H. et al., A new technique for audio packet loss concealment, Nov. 18-22, 1996, GLOBECOM '96, pp.:48-52.*

Roelands, Marc et al., Waveform similarity based overlap-add (WSOLA) for time-scale modification of speech: structures and evaluaton, EUROSPEECH'93, 337-340.*

(Continued)

*Primary Examiner*—Vijay Chawan
*Assistant Examiner*—Myriam Pierre

(57) ABSTRACT

The method and preprocessor enhances the intelligibility of narrowband speech without essentially lengthening the overall time duration of the signal. Both spectral enhancements and variable-rate time-scaling procedures are implemented to improve the salience of initial consonants, particularly the perceptually important formant transitions. Emphasis is transferred from the dominating vowel to the preceding consonant through adaptation of the phoneme timing structure. In a further embodiment, the technique is applied as a preprocessor to a speech coder.

25 Claims, 10 Drawing Sheets

OTHER PUBLICATIONS

Wayman, J.L. et al., High quality speech expansion, compression, and noise filtering using the sola method of time scale modification, Oct. 30-Nov. 1, 1989, Signals, Systems and Computers, Twenty-Third Asilomar Conference,vol. 2, pp.:714-717.*

Wong, P.H.W. et al. On improving the intelligibility of synchronized over-lap-and-add (SOLA) at low TSM factor, Dec. 2-4, 1997, TENCON '97. IEEE Region 10 Annual Conference. SITCT, vol. 2, pp.: 487-490.*

Covell, M., et al., MACH1: nonuniform time-scale modification of speech Acoustics, Speech, and Signal Processing, May 12-15, 1998, ICASSP '98. Proceedings of the 1998 IEEE International Conference, vol. 1, pp.:349-352.*

Erogul, O. et al., Time-scale modification of speech signals for language-learning impaired children, May 20-22, 1998, Biomedical Engineering Days, 1998. Proceedings of the 1998 2nd International Conference, pp.:33-35.*

Ross, K.N. et al., A dynamical system model for generating fundamental frequency for speech synthesis, May 1999, Speech and Audio Processing, IEEE Transactions, vol. 7, Issue 3, pp.: 295-309.*

Yong, M., et al., Study of voice packet reconstruction methods applied to CELP speech coding, Mar. 23-26, 1992, ICASSP-92, IEEE International Conference, vol. 2, pp.:125-128.*

Verhelst, Werner, "Overlap-add Methods for Time-Scaling of Speech," *Speech Communications,* 30(2000), pp. 207-221.

David Kapilow, et al., "Detection of Non-Stationarity in Speech Signals and Its Application to Time-Scaling.", 6th European Conference on *Speech Communication and Technology,* Sep. 5-9, 1999, Budapest, Hungary, vol. 5, pp. 2307-2310.

Hazan, Valerie, et al., "The Effect of Cue-Enhancement on the Intelligibility of Nonsense Word and Sentence Materials Present in Noise," *Speech Communication,* 4(1998), pp. 211-226.

Balakrishnan, Uma, et al., "Consonant Recognition for Spectrally Degraded Speech as a Function of Consonant-Vowel Intensity Ratio," *Journal of the Acoustical Society,* 99(6), Jun. 1996, pp. 3758-3768.

Gordon-Salant, "Recognition of Natural and Time/Intensity Altered CVs by Young and Elderly Subjects with Normal Hearing," *Journal of the Acoustical Society,* 80(6), Dec. 1986, pp. 1599-1607.

Furui, Sadaoki, "On the Role of Spectral Transition for Speech Perception," *Journal of the Acoustical Society of America,* 80(4), Oct. 1986, pp. 1016-1025.

Dorman, M.F., et al., "Phonetic Identification by Elderly Normal and Hearing-Impaired Listeners," *Journal of the Acoustical Society of America,* 77(2), Feb. 1985, pp. 664-670.

Steven, Kenneth N., Phonetic Linguistics, ISBN 0-12268990-9, *Academic Press, Inc,* 1985, pp. 243-255.

Huggins, A.W.F., "Just Noticeable Differences for Segment Duration in Natural Speech," *Journal of the Acoustical Society of America,* 51(4), 1972, pp. 1270-1278.

Miller, George A., et al., "An Analysis of Perceptual Confusions Among Some English Consonants," *Journal of the Acoustical Society of America,* 27(2), Mar. 1955, pp. 338-352.

* cited by examiner

ENHANCING SPEECH INTELLIGIBILITY USING VARIABLE-RATE TIME-SCALE MODIFICATION

FIELD OF THE INVENTION

The present invention relates to a modification of a speech signal in order to enhance the intelligibility of the associated speech.

BACKGROUND OF THE INVENTION

Reducing the bandwidth associated with a speech signal for coding applications often results in the listener having difficulty in understanding consonant sounds. It is desirable to strengthen the available acoustic cues to make consonant contrasts more distinct, and potentially more robust to subsequent coding degradations. The intelligibility of speech is an important issue in the design of speech coding algorithms. In narrowband speech the distinction between consonants can be poor, even in quiet conditions and prior to signal encoding. This happens most often for those consonants that differ by place of articulation. While reduced intelligibility may be partly attributed to the removal of high frequency information, resulting in a loss of cue redundancy, the problem is often intensified by the weak nature of the acoustic cues available in consonants. It is thus advantageous to strengthen the identifying cues to improve speech perception.

Speakers naturally revise their speech when talking to impaired listeners or in adverse environments. This type of speech, known as clear speech, is typically half the speaking rate of conversational speech. Other differences include longer formant transitions, more salient consonant contrasts (increased consonant-vowel ratio, CVR), and pauses, which are more frequent and longer in duration. Prior art attempts to improve intelligibility involve artificially modifying speech to possess these characteristics. Although increased CVR may lead to improved intelligibility in the presence of noise due to the inherent low energy of consonants, in a noise-free environment, significantly modifying the natural relative CV amplitudes of a phoneme can prove unfavorable by creating the perception of a different phoneme.

Techniques for the selective modification of speech duration to improve or maintain the level of intelligibility have also been proposed. There are two main approaches. The first approach modifies the speech only during steady-state sections by increasing the speaking rate without causing a corresponding decrease in quality or intelligibility. Alternatively, the speech may be modified only during non-steady-state, transient regions. Both approaches result in a change in the signal duration, and both detect and treat transient regions of speech in a different manner from the rest of the signal. For real-time applications, however, the signal duration must remain essentially unchanged.

Thus, there is a need to enhance the intelligibility of narrowband speech without lengthening the overall duration of the signal.

BRIEF SUMMARY OF THE INVENTION

Transmission and processing of a speech signal is often associated with bandwidth reduction, packet loss, and the exacerbation of noise. These degradations can result in a corresponding increase of consonant confusions for speech applications. Strengthening the available acoustic cues to make consonant contrasts more distinct may provide greater robustness to subsequent coding degradations. The present invention provides methods for enhancing speech intelligibility using variable rate time-scale modification of a speech signal. Frequency domain characteristics of an input speech signal are modified to produce an intermediate speech signal, such that acoustic cues of the input speech signal are enhanced. Time domain characteristics of the intermediate speech signal are then modified to produce an output signal, such that steady-state and non-steady-state parts of the intermediate speech signal of the intermediate speech signal are oppositely modified.

An exemplary embodiment is disclosed that enhances the intelligibility of narrowband speech without lengthening the overall duration of the signal. The invention incorporates both spectral enhancements and variable-rate time-scaling procedures to improve the salience of initial consonants, particularly the perceptually important formant transitions. Emphasis is transferred from the dominating vowel to the preceding consonant through adaptation of the phoneme timing structure.

In a second exemplary embodiment of the present invention, the technique is applied as a preprocessor to the Mixed Excitation Linear Prediction (MELP) coder. The technique is thus adapted to produce a signal with qualities favorable for MELP encoding. Variations of the embodiment can be applied to other types of speech coders, including code excited linear prediction (CELP), vector sum excitation (VSELP), waveform interpolation (WI), multiband excitation (MBE), linear prediction coding (LPC), pulse code modulation (PCM), differential pulse code modulation (DPCM), and adaptive differential pulse code modulation (ADPCM).

DETAILED DESCRIPTION OF THE INVENTION

Figure 1:
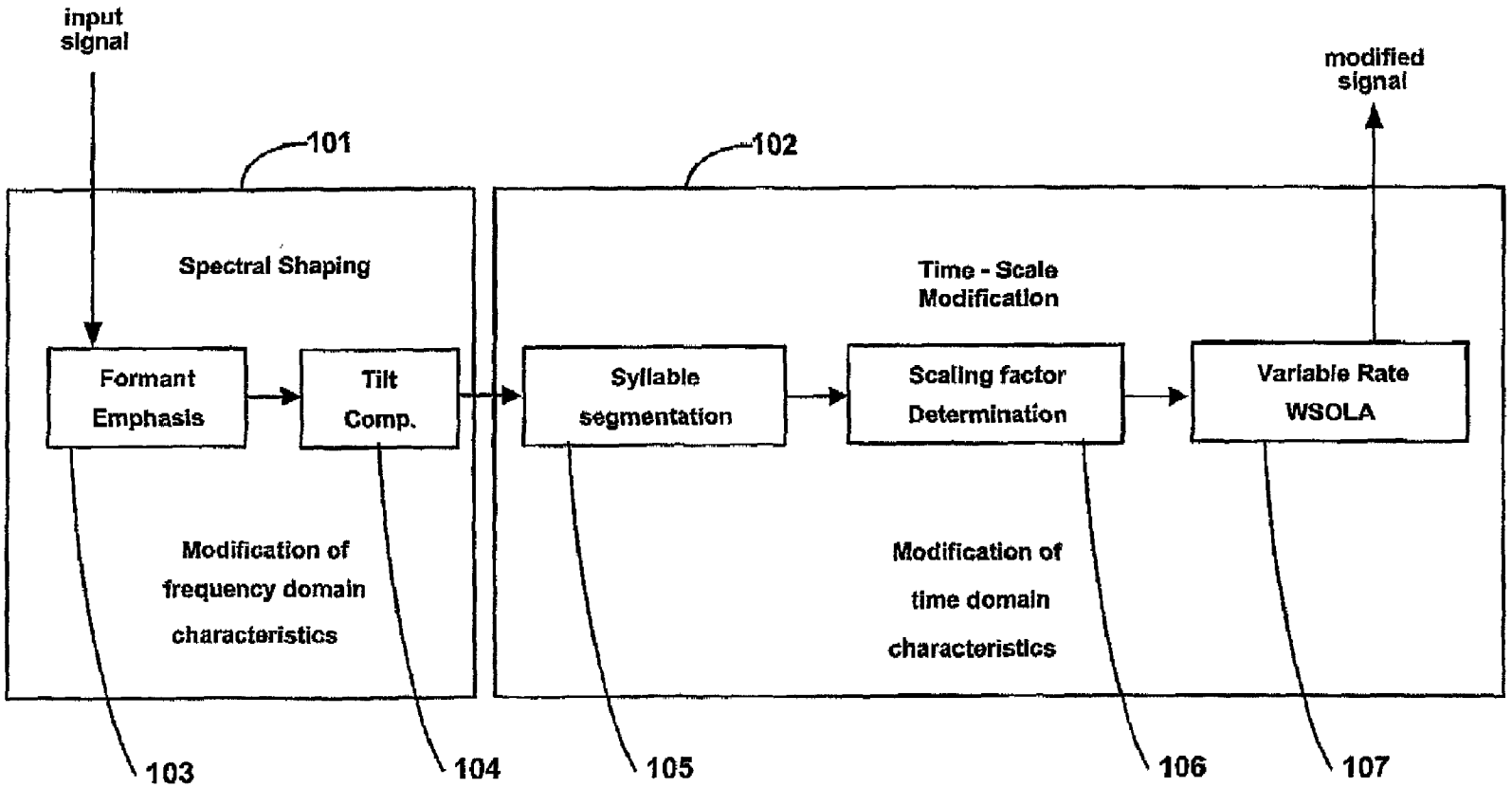
FIG. 1 is a block diagram of the enhancement algorithm of the present invention.

The vowel sounds (often referenced as voiced speech) carry the power in speech, but the consonant sounds (often referenced as unvoiced speech) are the most important for understanding. However, consonants, especially those within the same class, are often difficult to differentiate and are more vulnerable to many forms of signal degradation. For example, speech (as conveyed by a signal) may be degraded in a telecommunications network that is characterized by packet loss (for a packetized signal) or by noise. By appropriately processing the speech signal, the processed speech signal may be more immune to subsequent degradations.

Preliminary experiments analyzing the distinction between confusable word pairs show that intelligibility can be improved if the test stimuli were presented twice to the listener, as opposed to only once. It is hypothesized that when the first time the word is heard, the high-intensity, longer duration vowel partially masks the adjacent consonant. When the word is repeated, the vowel is already known and expected, allowing the listener to then focus on identifying the consonant. To eliminate the need for repetition, it is desirable to reduce the vowel emphasis, and increase the salience of the consonant cues to weaken the masking effect.

The most confusable consonant pairs are those that differ by place of articulation, e.g. /p/-/t/, /f/-/th/. These contain their main distinctive feature during their co-articulation with adjacent phonemes, characterized by the consonant-vowel formant transitions. To emphasize the formant structure, transient regions of speech are slowed down, while the contrasts are increased between spectral peaks and valleys. In addition, the steady state vowel following a syllable-initial consonant is compressed. The compression serves at least three main purposes. First, it accentuates the longer consonant length; second, it preserves the waveform rhythm to maintain naturalness; and third, it results in minimum overall phrase time duration change, which allows the technique of the present invention to be employed in real-time applications.

Common methods used to modify the time duration of speech without altering perceived frequency attributes are overlap-add (OLA) techniques. OLA is a time-domain technique that modifies the time-scale of a signal without altering its perceived frequency attributes. OLA constructs a modified signal that has a short-time Fourier Transform (STFT) maximally close to that of the original signal. These techniques are popular due to their low complexity, allowing for real-time implementation. OLA techniques average overlapping frames of a signal at points of highest correlation to obtain a time-scaled signal, which maintains the local pitch and spectral properties of the original signal. To reduce discontinuities at waveform boundaries and improve synchronization, the waveform similarity overlap-add (WSOLA) technique was developed. WSOLA overcomes distortions of OLA by selecting the segment for overlap-addition, within a given tolerance of the target position, such that the synthesized waveform has maximal similarity to the original signal across segment boundaries. The synthesis equation for WSOLA with regularly spaced synthesis instants kL and a symmetric unity gain window, v(n), is:

$$y(n) = \sum_k v(n - kL) \cdot x(n + \tau^{-1}(kL) + \Delta_k - kL) \tag{1}$$

where $\tau^{-1}$ (kL) represents time instants on the input signal, and $\Delta_k \epsilon [-\Delta_{max} \ldots \Delta_{max}]$ is the tolerance introduced to achieve synchronization.

To find the position of the best-matched segment, the normalized cross-correlation function is maximized as follows:

$$c_n(m, \delta) = \frac{\sum_{n=0}^{N-1} x(n + \tau^{-1}((m-1)L) + \Delta_{m-1} + L) \cdot x\left(\sum_{n=0}^{N-1} x(n + \tau^{-1}(\mathrm{mL}) + \delta)\right)}{\sqrt{\sum_{n=0}^{N-1} x^2(n + \tau^{-1}(\mathrm{mL}) + \delta)}} \tag{2}$$

where N is the window length.

With the present invention, the intelligibility enhancement algorithm enhances the identifying features of syllable-initial consonants. It focuses mainly on improving the distinctions between initial consonants that differ by place of articulation, i.e. consonants within the same class that are produced at different points of the vocal tract. These are distinguished primarily by the location and transition of the formant frequencies. The method can be viewed as a redistribution of segment durations at a phonetic level, combined with frequency-selective amplification of acoustic cues. This emphasizes the co-articulation between a consonant and its following vowel. In one embodiment the algorithm is used in a preprocessor in real-time speech applications. The enhancement strategy, illustrated in FIG. 1, is divided into two main parts: a first portion 101 for modification of frequency domain characteristics, and a second portion 102 for modification of time-domain characteristics.

In the exemplary embodiment of the present invention, modification of the frequency domain characteristics in first portion 101 involves adaptive spectral enhancement (enhancement filter 103) to make the spectral peaks more distinct, and emphasis (tilt compensator 104) of the higher frequencies to reduce the upward spread of masking. This is then followed by the time-domain modification of second portion 102, which automatically identifies the segments to be modified (syllable segmentation 105), determines the appropriate time-scaling factor (scaling factor determination 106) for each segment depending on its classification (formant transitions are lengthened and the dominating vowel sound and silence periods are compressed in time), and scales each segment by the desired rate (variable rate WSOLA 107) while maintaining the spectral characteristics.

The resulting modified signal has a speech waveform with enhanced initial consonants, while having approximately the same time-duration as the original input signal.

Selective frequency band amplification may be applied to enhance the acoustic cues. Non-adaptive modification, however, may create distortions or, in the case of unvoiced fricatives especially, may bias perception in a particular direction. For best emphasis of the perceptually important formants, an adaptive spectral enhancement technique based on the speech spectral estimate is applied. The enhancement filter 103 is based on the linear prediction coefficients. The purpose, however, is not to mask quantization noise as in coding synthesis, but instead to accentuate the formant structure.

The tilt compensator 104 applies tilt compensation after the formant enhancement to reduce negative spectral tilt. For intelligibility, it may be desirable not only to flatten the spectral tilt, but also to amplify the higher frequencies. This is especially true for the distinction of unvoiced fricatives. A high frequency boost reduces the upward spread of the masking effect, in which the stronger lower frequencies mask the weaker upper frequencies. For simplicity, a first order filter is applied.

The adaptive spectral enhancement filter is:

$$H(z) = (1 - \alpha z^{-1})\frac{A(z/\gamma_1)}{A(z/\gamma_1)}, \tag{3}$$

where, $\gamma_1$=0.8, $\gamma_2$=0.9, $\alpha$=0.2, and 1/A(z) is a $10^{th}$ order all-pole filter which models the speech spectrum. These constants are determined through informal intelligibility testing of confusable word pairs. In the exemplary embodiment the constants remain fixed; however, in variations of the exemplary embodiment they are determined adaptively in order to track the spectral tilt of the current speech frame.

Modification of the phoneme durations is an important part of the enhancement technique. Time-scale modification is commonly performed using overlap-add techniques with constant scaling factor. In some applications, the modification is performed for playback purposes; in other words, the speech signal is stored and then either compressed or expanded for listening, as the user requires. In such applications constraints on speech delay are not strict, allowing arbitrary expansion, and the entire duration of the speech is available a priori. In such cases, processing delays are not of paramount importance, and the waveform can be continuously compressed without requiring pauses in the output. However, the present invention allows the process to operate at the time of speaking, essentially in real-time. It is therefore necessary to constrain delays, both look-ahead and those caused by signal retardation. Any segment expansions must be compensated by compression of the following segment, in order to provide for speaker-to-speaker interaction. In variable-rate time-scale modification the choice of scaling factor is based on the characteristics of the target speech segment.

Figure 2:
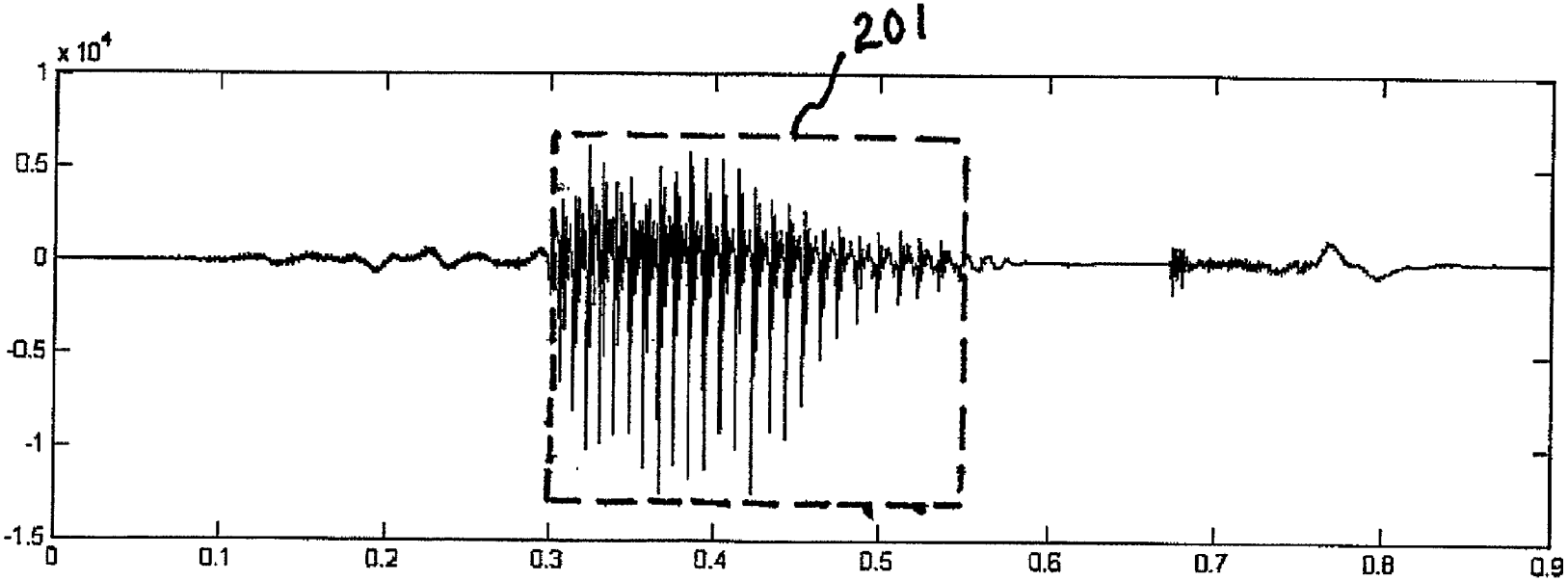
FIG. 2 depicts a time-scale modification syllable (TSMS) of the word "sank"

First, syllables that are to be expanded/compressed are determined in syllable segmentation 105. In the exemplary embodiment, syllables correspond to the consonant-vowel transitions and the steady-state vowel combinations. The corresponding speech region, as illustrated as boundary 201 in FIG. 2, is referred to as the time-scale modification syllable (TSMS). Note, the TSMS only contains quasi-periodic speech. Typically, a TSMS has a time duration between 100 msec to 300 msec. The TSMS does not include the initial features of the consonant such as stop bursts, frication noise, or pre-voicing. Thus, the detection measures that are most appropriate will differ from other time-scale modification techniques, which attempt to locate regions of non-stationarity. In other variations of the exemplary embodiment, other types of speech structures can correspond to a syllable. In general, syllable boundaries can be flexible. For example, the entire vowel sound may or may not be included in the TSMS segment.

Automatic detection of the TSMS is important procedure of the algorithm. Any syllables that are wrongfully identified can lead to distortions and unnaturalness in the output. For example with fast speech, two short syllables may be mistaken for a single syllable, resulting in an undesirable output in which the first syllable is excessively expanded, and the second is almost lost due to full compression. Hence, a robust detection strategy is required. Several methods may be applied to detect TSMS boundaries including the rate of change of spectral parameters (line spectral frequencies (LSFs), cepstral coefficients), rate of change of energy, short-time energy, and cross-correlation measures.

If the look-ahead delay is to be minimized, the most efficient method to locate the TSMS is a cross-correlation measure that can be obtained directly from WSOLA synthesis of the previous frame. However, considerable performance improvements (fewer boundary errors and/or distortions in the modified speech) are realized when the TSMS duration is known before its modification begins; hence the reduced complexity advantages cannot be capitalized upon. Both the correlation and energy measures can identify long duration high-energy speech sections of the signal that correspond to voiced portions to be modified. The short-time energy, $E_n$, of the signal x(t) centered at time t=n, is calculated as $$E_n = \sqrt{\frac{1}{N+1}\sum_{m=-N/2}^{N/2} x^2(n+m)} \tag{4}$$

where the window length N=20 ms. However, time-domain measures have difficulty discriminating two syllables in a continuous voiced section. TSMS detection is more reliably accomplished using a measure that detects abrupt changes in frequency-domain characteristics, such as the known spectral feature transition rate (SFTR). The SFTR is calculated as the gradient, at time n, between the Line Spectral Frequencies (LSFs), $y_l$, within the interval [n±M]. This is given by the equation:

$$SFTR = \sum_{l=1}^{P} (g_n^l)^2 \tag{5}$$

where, the gradient of the $l^{th}$ LSF, is $$g_n^l = \frac{\sum_{m=-M}^{M} m y_l(n+m)}{\sum_{m=-M}^{M} m^2}, \quad l = 1, \ldots, P \tag{6}$$

and P, the order of prediction, is 10. LSFs are calculated every 10 ms using a window of 30 ms. The SFTR can then be mapped to a value in the range [0, 1], by the function:

$$C_n = \frac{2}{1 + e^{-\beta(SFTR)}} - 1 \quad (7)$$

where, the variable β is set to 20.

Figure 3:
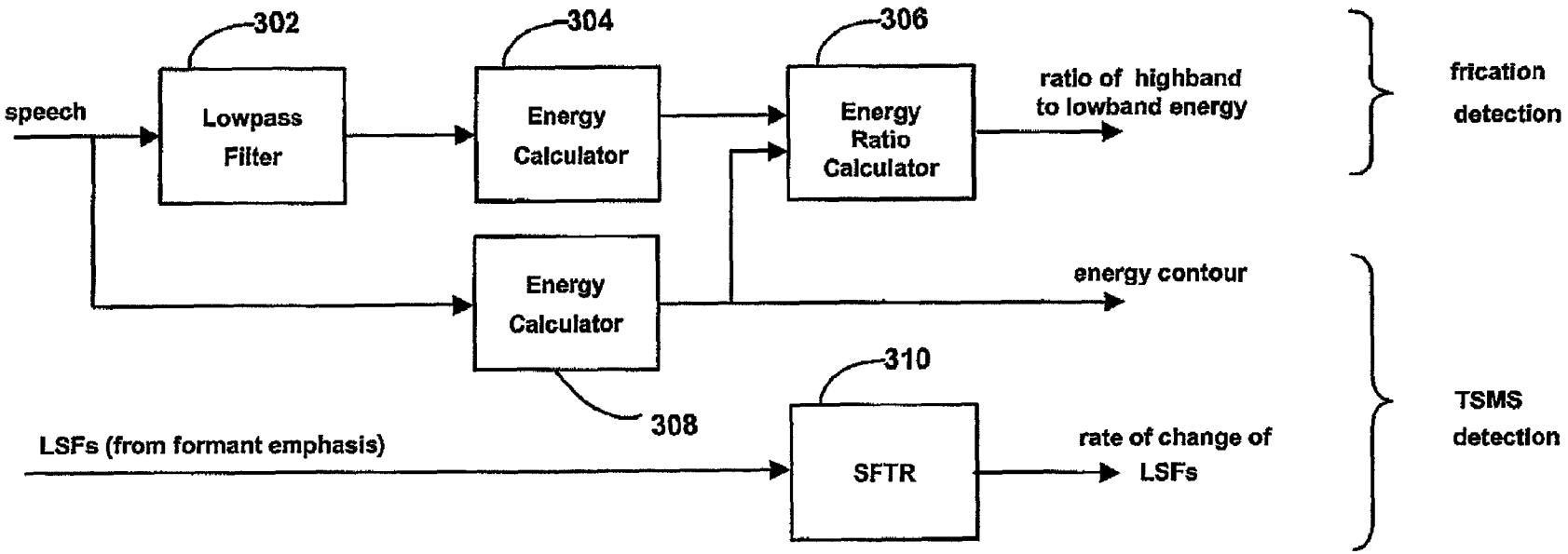
FIG. 3 depicts measures used to locate syllables to time-scale.
Figure 4:
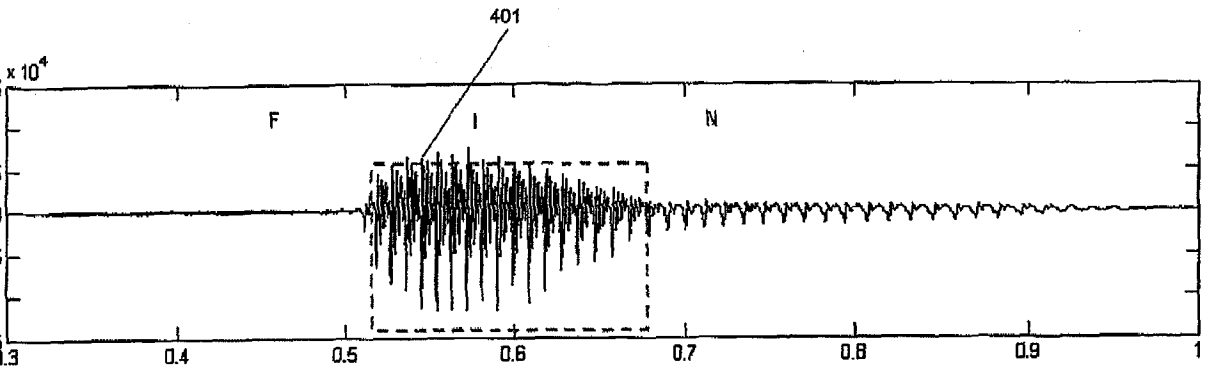
FIG. 4 depicts locating the time-scale modification syllable for the word "fin" according to a speech waveform.
Figure 5:
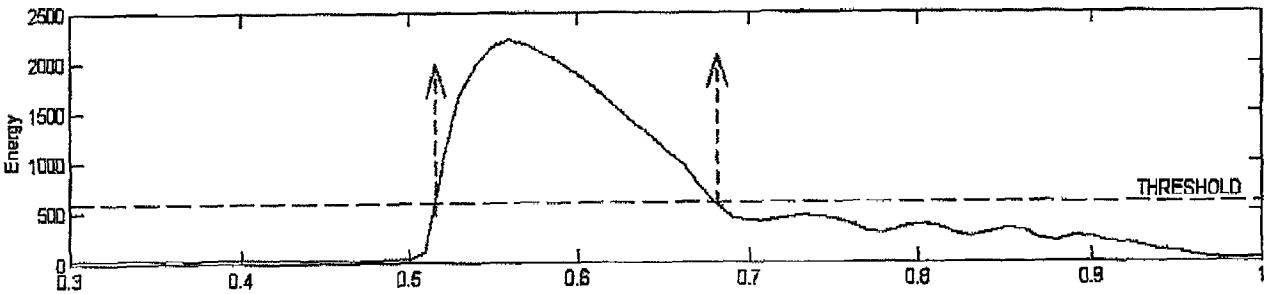
FIG. 5 depicts locating the time-scale modification syllable for the word "fin" according to an energy contour.
Figure 6:
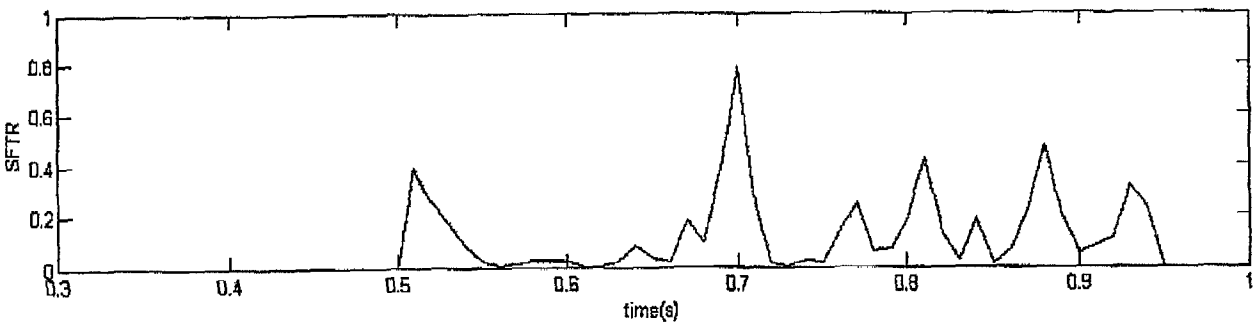
FIG. 6 depicts locating the time-scale modification syllable for the word "fin" according to a spectral feature transition rate (SFTR)

In the exemplary embodiment, syllable segmentation is thus performed using a combination of two measures: one that detects variability in the frequency domain and one that identifies the durations of high energy regions. In the exemplary embodiment, the energy contour is chosen instead of the correlation measure because of its reduced complexity. While the SFTR requires the computation of LSFs at every frame, it contributes substantial reliability to the detection measure. Computational savings may be realized if the technique is integrated within a speech encoder. In simplified terms, the boundaries of the TSMS are first estimated by thresholding the energy contour by a predefined value. The SFTR acts as a secondary measure, to reinforce the validity of the initial boundary estimates and to separate syllables occurring within the same high energy region when a large spectral change occurs. FIG. 3 illustrates the measures used to detect the syllable to time-scale. An input (speech) signal is processed by lowpass filter 302, energy calculator 304 and energy ratio calculator 306 to provide a ratio of highband to lowband energy that is subsequently utilized for fricative detection. The speech signal is also processed by energy calculator 308 to determine an energy contour. The LSFs from formant emphasis 103 is processed by SFTR 310 to determine a rate of change of LSFs. The energy contour and the rate of change of LSFs are utilized to locate the TSMS boundaries, are shown in FIGS. 4, 5, and 6. FIG. 4 depicts locating the time-scale modification syllable for the word "fin" according to a speech waveform. Boundary 401 corresponds to a TSMS of approximately 175 msec in time duration. FIG. 5 depicts locating the time-scale modification syllable for the word "fin" according to an energy contour. FIG. 6 depicts locating the time-scale modification syllable for the word "fin" according to a spectral feature transition rate (SFTR).

Since unvoiced fricatives are found to be the least intelligible of the consonants in intelligibility tests previously performed, an additional measure is included to detect frication noise. The energy of fricatives is mainly localized in frequencies beyond the available 4 kHz bandwidth, however, the ratio of energy in the upper half-band to that in the lower half-band is found to be an effective identifying cue. If this ratio lies above a predefined threshold, the segment is identified as a fricative. Further enhancement (amplification, expansion) of these segments is then feasible.

Once the TSMSs have been identified, an appropriate time-scaling factor is dynamically determined by the time scale determinator 106 for each 10 ms-segment of the frame. (A segment is a portion of speech that is processed by a variable-rate scale modification process.) The strategy adopted is to emphasize the formant transitions through time expansion. This effect is then strengthened by compressing the following vowel segment. Hence, the first portion of the TSMS containing the formant transitions is expanded by $\alpha_{tr}$. The second portion containing the steady-state vowel is compressed by $\alpha_{ss}$. Fricatives are lengthened by $\alpha_{fric}$. The scaling factors are defined as follows:

$\alpha<1$ corresponds to lengthening the time duration of the current segment, $\alpha>1$ corresponds to compression, and $\alpha=1$ corresponds to no time-scale modification at all.

Time scaling is inversely related to the scaling factor. Typically, $\alpha_{tr}=1/\alpha_{ss}$; however for increased effect, $\alpha_{tr}<1/\alpha_{ss}$. Significant changes in time duration, e.g. $\alpha>3$, may introduce distortions, especially in the case of stop bursts. The factors used in the current implementation are: $\alpha_{tr}=0.5$, $\alpha_{ss}=1.8$ and $\alpha_{fric}=0.8$. In low energy regions of the speech, residual delays may be reduced by scaling the corresponding speech regions by the factor $\alpha_{sil}=\min(1.5, 1+d/(LF_s))$, where d is the current delay in samples, L is the frame duration and $F_s$ is the sampling rate.

In a variation of the exemplary embodiment of the present invention, the first one third of the TSMS is slowed down and the next two thirds are compressed. However, delay constraints often prevent the full TSMS duration from being known in advance. This limitation depends on the amount of look-ahead delay, $D_L$, of the algorithm and the speaking rate. Since the ratio of expansion to compression durations is 1:2, the maximum TSMS length, foreseeable before the transition from $\alpha_{tr}$ to $\alpha_{ss}$ may be required, is $1.5*D_L$. If the TSMS duration is greater than $1.5*D_L$, the length of the portion to be expanded is set to a value, $N \geqq 0.5*D_L$, which depends on the energy and SFTR characteristics. Compression of the next 2N ms then follows; however, this may be interrupted if the energy falls below the threshold during this time.

Figure 7:
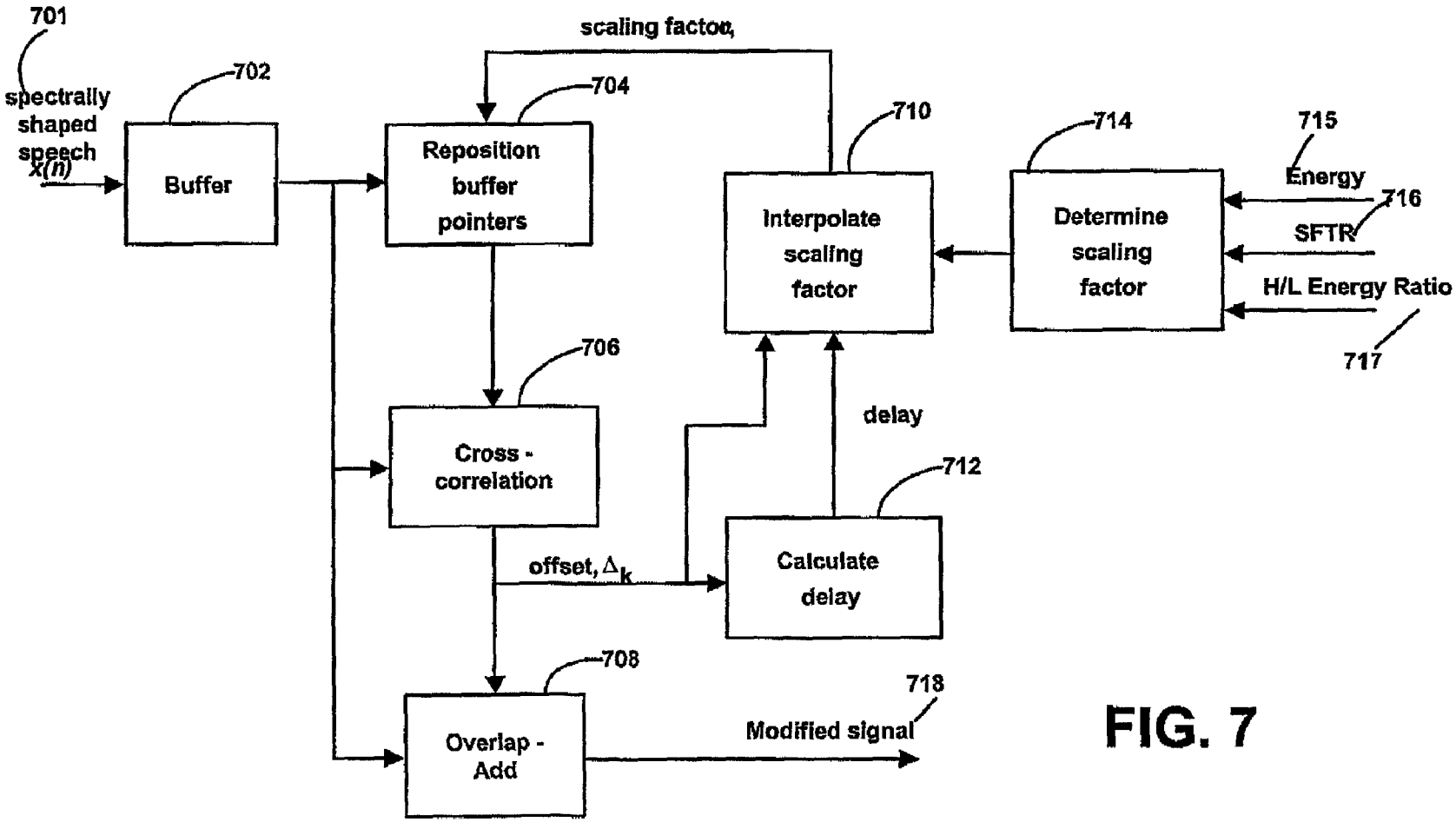
FIG. 7 is a block diagram of the variable-rate time-scale modification procedure.

With D=100 ms, the chosen scaling factors typically result in a total delay less than 150 ms, although delay may peak up to 180 ms very briefly during words containing fricatives. A block diagram of the variable-rate time-scale modification procedure is shown in FIG. 7. The underlying technique is WSOLA with an additional facility of accommodating a variable scaling factor. Speech signal 701 (which may be spectrally shaped in accordance with function 101 in FIG. 1) is stored in buffer 702 for subsequent processing. The speech signal is variably time-scaled by functions 714 and 710. Function 714 utilizes energy information 715, SFTR 716, and high/low energy ratio information 717 to detect a TSMS and to consequently determine a scaling factor for each region of the speech signal. Depending on the value of the scaling factor, the position of the current and target pointers are adjusted with reposition buffer pointer function 704. With function 706, a search using cross-correlation is then performed to find the segment within a given tolerance of the target position that has maximum similarity to the continuation of the last extracted segment. After each best-match search, the delay is calculated with function 712. This is to ensure that the maximum allowable delay is not exceeded, as well as to determine the current residual delay that may be diminished during future low-energy periods. Since the analysis to determine the desired amount of scaling is performed at a constant rate of time, the scaling factor is updated (with function 710) after each overlap-add operation (function 708) with the value associated with the closest corresponding point in the input signal to provide modified signal 718. With very low energy frames, further compression may take place to reduce the variable residual delay to zero.

Figure 8:
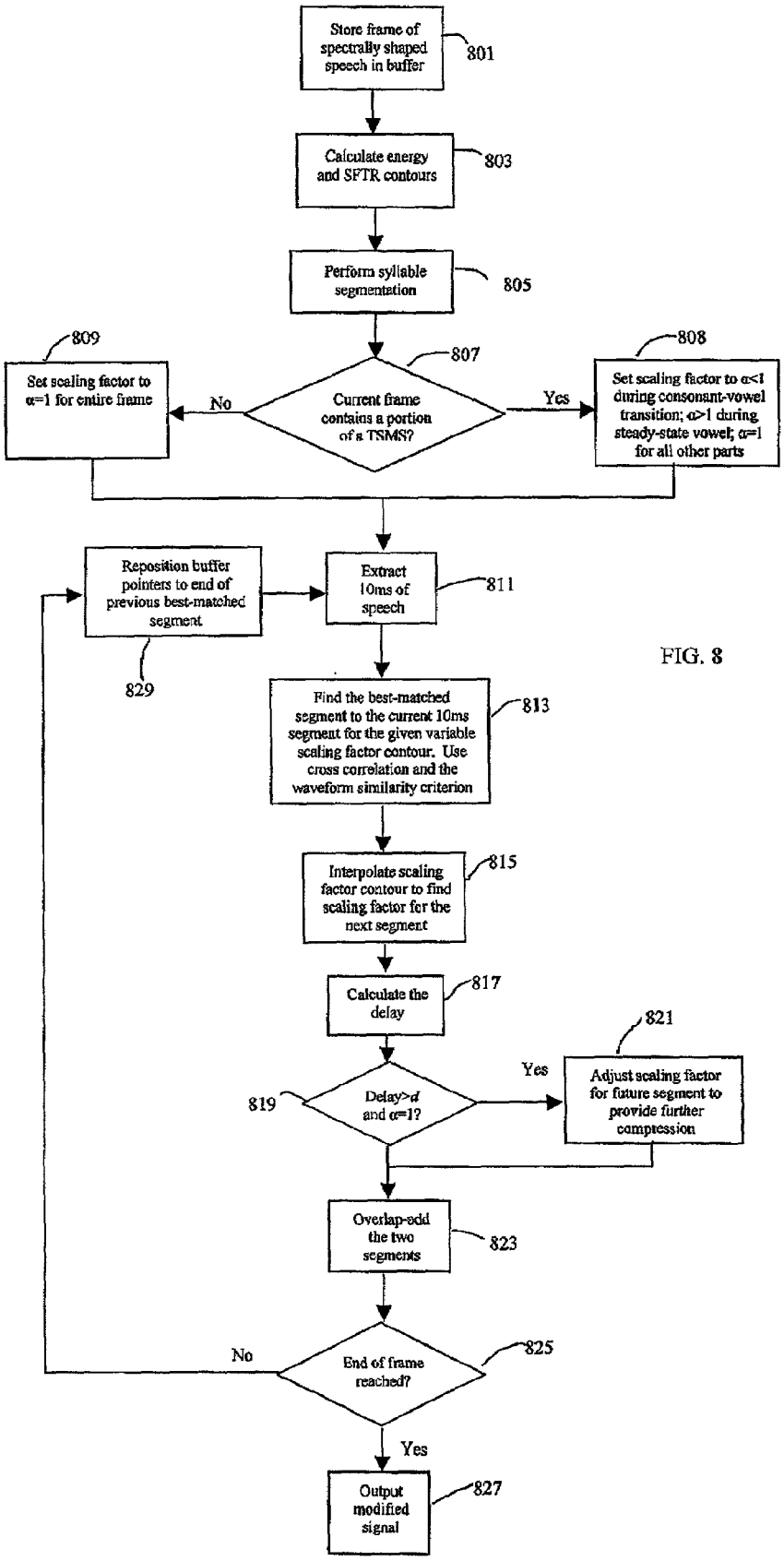
FIG. 8 is a flow diagram corresponding to FIG. 7.
Figures 9, 10, 11, 12:
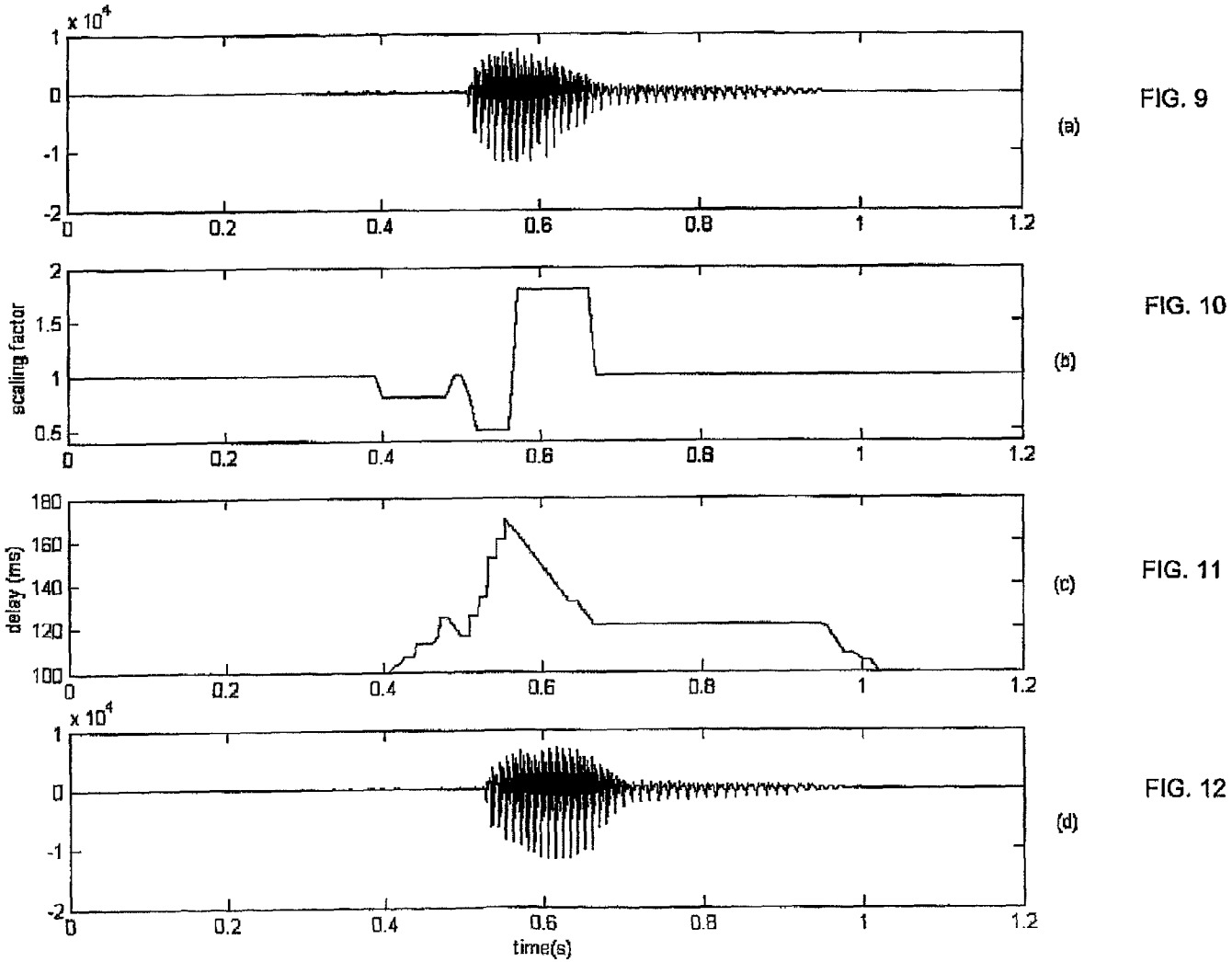
FIG. 9 depicts an input signal corresponding to the word "fin"
FIG. 10 depicts the self-determined scaling factors during the time duration corresponding to FIG. 9.
FIG. 11 depicts the total delay (including a 100 ms look-ahead delay) during the time duration corresponding to FIG. 9.
FIG. 12 depicts the output variable rate time-scale modification of the word "fin"

FIG. 8 shows a flow diagram in accordance with the functional diagram of the exemplary embodiment that is shown in FIG. 7. In step 801, a frame of the speech signal is stored into a buffer corresponding to buffer 702) for subsequent processing in accordance with the process shown in FIG. 8. (In the exemplary embodiment, the speech signal can correspond to an analog signal or can be digitized by sampling the analog signal and converting the samples into a digital representation to facilitate storing in buffer 702.) The frame is typically of fixed duration of the speech signal (e.g. 20 msec). In step 803 the energy and the SFTR contours (corresponding to energy calculator function 308 and SFTR function 310, respectively) is determined for further processing in step 805. In step 805, syllable segmentation determines if a TSMS occurs, and if so, the time position of the TSMS. In step 807, if a TSMS is detected and if a consonant-vowel transition occurs (step 808), the corresponding duration speech signal (typically a segment) is time scaled with the scaling factor ($\alpha<1$). However, the corresponding duration of the speech signal is time scaled with a scaling factor ($\alpha>1$) during a steady-state vowel. For other portions of the TSMS, the scaling factor is equal to 1 (in other words, the corresponding speech signal is not time-scaled.) If a TSMS is not detected in step 807, then with step 809 the scaling factor is equal to 1 (no time scaling for the duration of the frame).

In step 811, the frame is processed in accordance with the constituent segments of speech. In the exemplary embodiment, a segment has a time duration of 10 msec. However, other variations of the embodiment can utilize different time durations for specifying a segment. In step 813, the segment is matched with another segment utilizing a cross-correlation and waveform similarity criterion (corresponding to function 706). A best-matched segment within a given tolerance of the target position to the continuation of the extracted segment is determined. (In the exemplary embodiment, the process in step 813 essentially retains the short-term frequency characteristics of the processed speech signal with respect to the inputted speech signal.) In step 815, the scaling factor is adjusted for the next segment of the frame in order to reduce distortion to the processed speech signal.

In step 817, the delay incurred by the segment is calculated. If the delay is greater than a time threshold in step 819, then the scaling factor is adjusted in subsequent segments in order to ensure that the maximum allowable delay is not exceeded in step 821. (Thus, the perceived effect of the real-time characteristics of the processed speech signal is ameliorated.)

In step 823, the segment and the best-matched segment are blended together (corresponding to function 708) by overlapping and added the two segments together, thus providing modified speech signal 718 when all the constituent segments of the frame have been processed in step 825. If the frame has not been completely processed, the buffer pointer is repositioned to correspond to the end of the best-matched segment that was previously determined in step 813. The processed speech signal is outputted to an external device or to a listener in step 827 when the frame has been completely processed. If the frame has not been completely processed, the buffer pointer is repositioned to the end of the best-matched segment (as determined in step 813) in step 829 so that subsequent segments of the frame can be processed.

FIGS. 9, 10, 11, and 12 show the original speech waveform for the word "fin", along with the selected scaling factor contour, incurred delay, and the modified output waveform, respectively. The lengthening of the both the "f" frication and the initial parts of the vocalic sections enhances the perception of formant transitions, and hence consonant contrasts. Since the scaling factors are chosen to slightly lengthen the duration of the TSMS, some residual delays are present during the final "n" sound. These are eliminated in the silence period.

Expansion of the initial part of the TSMS often shifts the highest energy peaks from the beginning to the middle of the word. This may affect perception, due to a slower onset of energy. To restore some of the initial energy at onset, the first 50 ms of the TSMS is amplified by a factor of 1.4, with the amplification factor gradually rolling-off in a cosine fashion. A purpose of the amplification is to compensate for reduced onset energy caused by slowing a segment and not to considerably modify the CVR, which can often create a bias shift.

When the above modifications are applied to sentence-length material, the resulting modified speech output sounds highly natural. While the output has a variable delay, the overall duration is the same as the original.

There are two types of delay that are incurred in this algorithm. The look-ahead delay, $D_L$, is required to estimate the length of each TSMS in order to correctly portion the expansion and compression time durations. This is a fixed delay. The residual delay, $D_R$, is caused by slowing down speech segments. This is a variable delay. The look-ahead delay and the residual delay are inter-related.

In general, the total delay increases up to ($D_L+N*\alpha_{tr}+D_R$) ms, as the formant transitions are lengthened. This delay is reduced, primarily during the remainder of the periodic segment and finally during the following low-energy region. It is not possible to eliminate 100% of the residual delay $D_R$ during voiced speech if there is to be a smooth continuation at the frame boundaries. This means that the residual delay $D_R$ typically levels out at one pitch period or less until the end of the voiced section is reached.

The best choice for the look-ahead delay $D_L$ depends on the nature of the speech. Ideally, it is advantageous to know the TSMS duration in advance to maximize the modification effect, but still have enough time to reduce the delay during the steady-state portion. This results in minimum residual delays, but the look-ahead delay could be substantial. Alternatively, a minimum look-ahead delay option can be applied, in which the duration of the segment to be expanded is fixed. This means that no look-ahead is required, but the output speech signal may sound unnatural and residual delays will build up if the fixed expansion length frequently exceeds one third of the TSMS duration. If the TSMS duration is underestimated, the modification effect may not reach its full potential. A compromise is to have a method that uses some look-ahead delay, for example 100 ms, and some variable delay.

The present invention combines variable-rate time-scale modification with adaptive spectral enhancement to increase the salience of the perceptually important consonant-vowel formant transitions. This improves the listener's ability to process the acoustic cues and discriminate between sounds. One advantage of this technique over previous methods is that formant transition lengthening is complemented with vowel compression to reinforce the enhanced consonant cues while also preserving the overall speech duration. Hence, the technique can be combined with real-time speech applications.

The drive towards lower speech transmission rates due to the escalating use of wireless communications places high demands on maintaining an acceptable level of quality and intelligibility. The 2.4 kbps Mixed Excitation Linear Prediction (MELP) coder was selected as the Federal Standard for narrowband secure voice coding systems in 1996. A further embodiment of the present invention emphasizes the co-articulation between adjacent phonemes by combining adaptive spectral enhancement with variable-rate time-scale modification (VR-TSM) and is utilized with the MELP coder. Lengthening of the perceptually important formant transitions is complemented with vowel compression both to reinforce the enhanced acoustic cues and to preserve the overall speech duration. The latter attribute allows the enhancement to be applied in real-time coding applications.

While intelligibility enhancement techniques may be integrated into the coding algorithm, for simplicity and portability to other frameworks, the inventive VR-TSM algorithm is applied as a preprocessor to the MELP coder with the second embodiment. Moreover, other variations of the embodiment may utilize other types of speech coders, including code excited linear prediction (CELP) and its variants, vector sum excitation (VSELP), waveform interpolation (WI, multiband excitation (MBE) and its variants, linear prediction coding (LPC), and pulse code modulation (PCM) and its variants. Since the VR-TSM enhancement technique is applied as a preprocessing block, no alterations to the MELP encoder/decoder itself are necessary. This also allows for emphasis and exaggeration of perceptually important features that are susceptible to coding distortions, to counterbalance modeling deficiencies.

The MELP coding technique is designed to operate on naturally produced speech, which contains familiar spectral and temporal properties, such as a −6 dB spectral tilt and, with the exception of pitch doubling and tripling, a relatively smooth variation in pitch during high-energy, quasi-periodic regions. The inventive intelligibility enhancement technique necessarily disrupts some of these characteristics and may produce others that are uncommon in natural speech. Hence, coding of this modified signal may cause some unfavorable effects in the output. Potential distortions in the coded output include high energy glitches during voiced regions, loss of periodicity, loss of pulse peakedness, and irregularities at voiced section onsets.

While both naturalness and the cues for the highly confusable unvoiced fricatives are enhanced with an upward tilt, the emphasis of the high frequency content can create distortions in the coded output. This includes a higher level of hiss during unvoiced speech, "scratchiness" during voiced speech and possibly voicing errors due to the creation of irregular high energy spikes which reduces similarity between pitch periods. On the other hand, formant enhancement, without tilt compensation, reduces the peakedness of pitch pulses. Since MELP synthesis already includes spectral enhancement, additional shaping prior to encoding is unnecessary unless it affects how well the formants are modeled. While a positive spectral tilt assists the MELP spectral analysis in modeling the higher formants, its accuracy is insufficient to gain intelligibility improvement.

Figure 14:
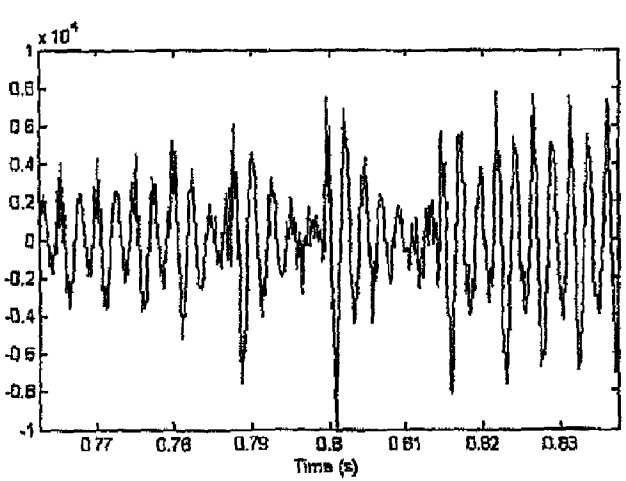
FIG. 14 depicts the effect of WSOLA pitch errors on a MELP coded signal having a the MELP coded enhanced signal.
Figure 13:
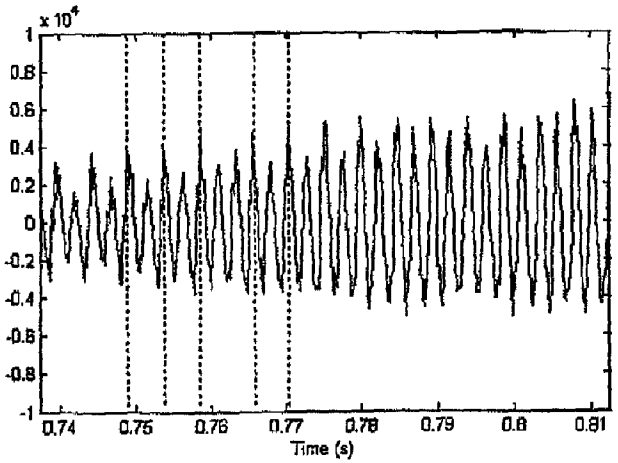
FIG. 13 depicts the effect of WSOLA pitch errors on the MELP coded signal having a time scale modification (TSM) signal with single "best-match"/pitch error.

A second potential source of distortion is the search for the best-matched segment in WSOLA synthesis. The criterion of waveform similarity in the speech-domain signal provides a less strict definition for pitch, and as shown in FIG. 13, may cause pitch irregularities. Such errors to a single pitch cycle are often unperceivable to the listener, but may be magnified and worsened considerably by low bit-rate coders as shown in FIG. 14. In the case depicted, the sudden, irregular shape and duration of one input cycle during a steady, periodic section of speech leads to loss of periodicity and high energy glitches in the MELP output. Glitches may also be produced near the onset of voiced segments if the time-scale modification procedure attempts to overlap-add two segments that are extremely different.

To prevent the above distortions from incurring precautionary measures are included within the intelligibility enhancement preprocessor. The adaptations include the removal of spectral shaping, improved pitch detection and increased time-scale modification constraints. These modifications are motivated by the constraints placed on the input waveform by the MELP coder, and may be unnecessary with other speech coding algorithms such as waveform coding schemes. To prevent irregular pitch cycles, the pitch is estimated every 22.5 ms using the MELP pitch detector prior to WSOLA modification. The interpolated pitch track, $p_{MELP}(i)$, then serves as an additional input to the WSOLA algorithm to guide the selection of the best-matched segment. The pitch as determined using WSOLA, $p_{WSOLA}(i)$, expressed as $$m\ p_{WSOLA}(n+\tau^{-1}(kL)+\Delta_k)=(1-\alpha)F_L+\Delta_{k-1}-\Delta_k,\ m=1,2,3\ldots\ k=1,2,3, \tag{8}$$

where $F_L$ is the overlap-add segment length, is then constrained during periodic sections to satisfy the condition:

$$p_{MELP}(i)-\delta \leqq p_{WSOLA}(i) \leqq p_{MELP}(i)+\delta. \tag{9}$$

During transitional regions, especially at voice onsets, interpolation of the MELP pitch is unreliable and hence is not used. During unvoiced speech, the "pitch" is not critical. While this necessarily adds further complexity, a smooth pitch contour is important for low rate parametric coders. Alternatively, a more efficient solution is to integrate a reliable pitch detector within the WSOLA best-match search.

In addition, further constraints are placed on the time-scale modification to avoid the creation of irregularities at voice onsets. A limit is placed on the maximum amount any segment may be expanded ($\alpha \geqq 0.5$). No overlap-addition of segments is permitted if the correlation between the best-matched segment and template is below a predefined threshold. This reduces the likelihood of smoothing out voice onsets or repeating an energy burst.

Figure 15:
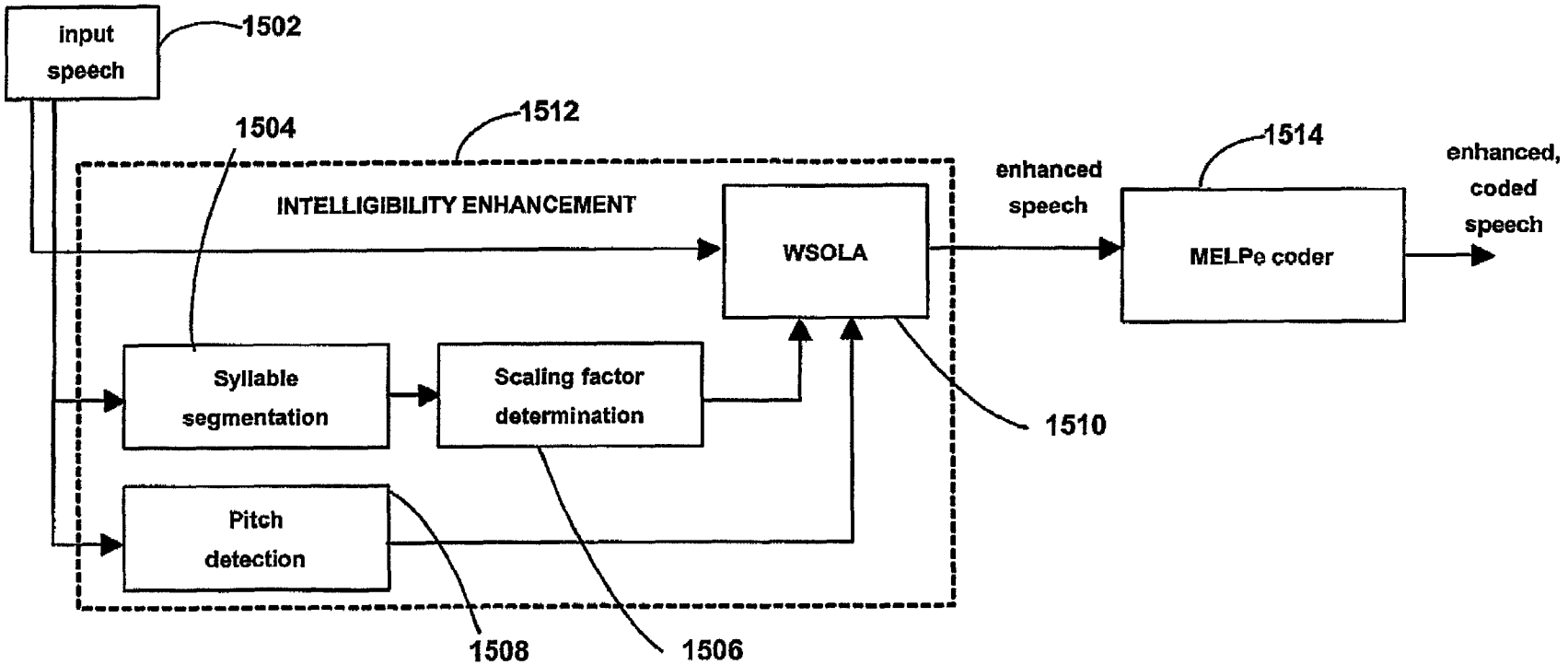
FIG. 15 depicts an intelligibility enhancement pre-processor for a MELPe speech coder.

FIG. 15 illustrates a functional diagram of the intelligibility enhancement 1512. The speech signal is stored in buffer 1502 for subsequent processing. Syllable segmentation 1504 detects and determines the location of a TSMS. Scaling factor determination function 1506 determines the scaling factor from syllable information form function 1504. If stored speech signal 1504 is characterized by being voiced speech, then pitch detection function 1508 determines pitch characteristics of the speech signal. WSOLA 1510 utilizes scaling information from function 1506 and pitch information from function 1508 in order to process the speech signal. The output of WSOLA is provided to MELPe (which is a variant of the MELP algorithm) coder 1514 for processing in accordance with the corresponding algorithm. (Other variations of the exemplary embodiment can support other types of coders, however.)

Figure 16:
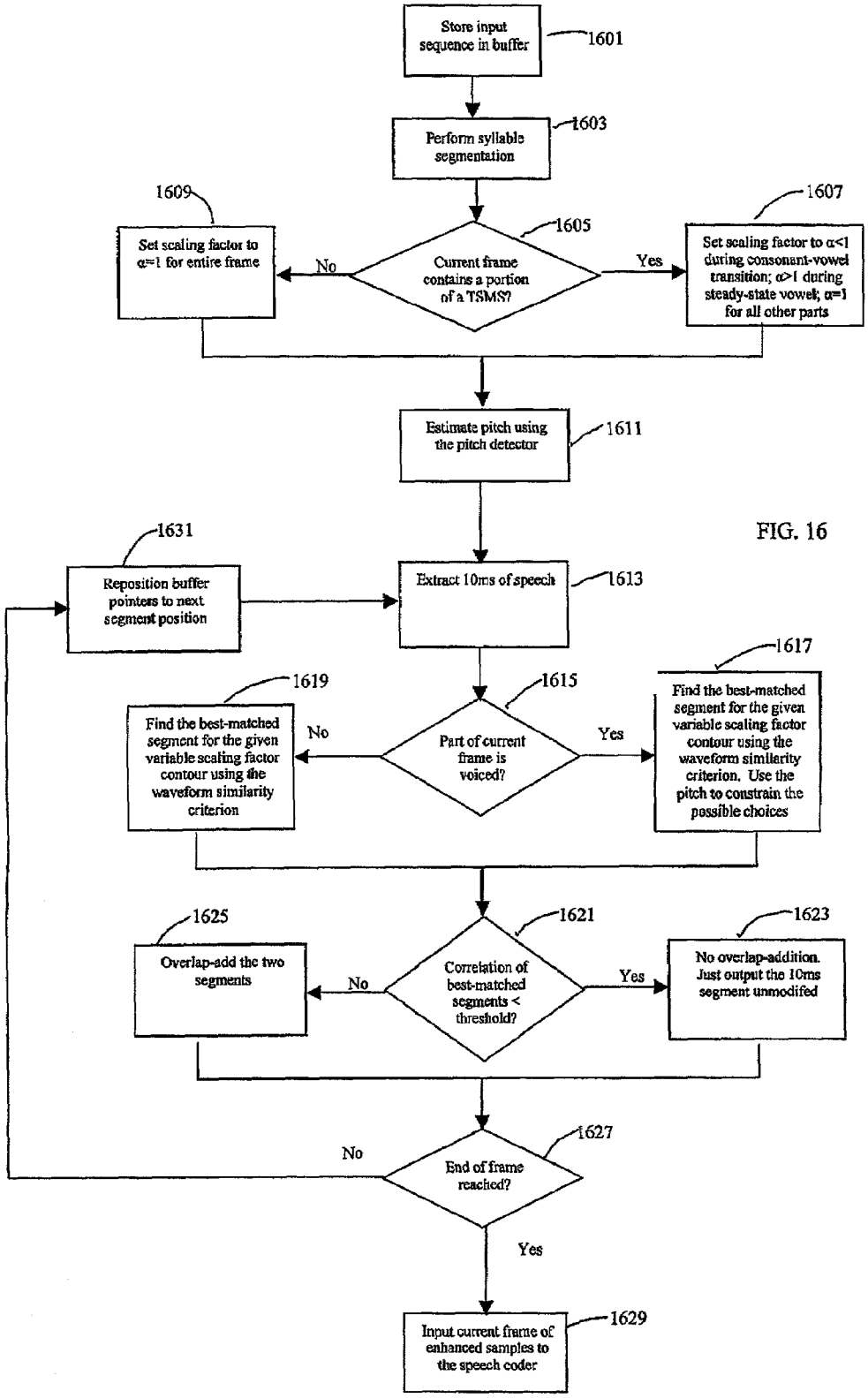
FIG. 16 is a flow diagram corresponding to FIG. 15.

FIG. 16 is a flow diagram corresponding to the functional diagram that is shown in FIG. 15. In step 1601, a frame of the speech signal is stored into a buffer. In step 1603, syllable segmentation (corresponding to function 1504) determines if a TSMS occurs, and if so, the time position of the TSMS. In step 1605, if a TSMS is detected and if a consonant-vowel transition occurs (step 1607), the corresponding duration speech signal (typically a segment) is time scaled with the scaling factor ($\alpha<1$). However, the corresponding duration of the speech signal is time scaled with a scaling factor ($\alpha>1$) during a steady-state vowel. For other portions of the TSMS, the scaling factor is equal to 1 (in other words, the corresponding speech signal is not time-scaled). If a TSMS is not detected in step 1605, then the scaling factor is equal to 1 in step 1609 (no time scaling for the duration of the frame).

In step 1611, the pitch component of the frame is estimated (corresponding to function 1508). In step 1613, the frame is processed in accordance with the constituent segments of speech. In the exemplary embodiment, a segment has a time duration of 10 msec. If the speech signal corresponding to the segment is voiced as determined by step 1615, then step 1617 determines the best-matched segment using a waveform similarity criterion in conjunction with the pitch characteristics that are determined in step 1611. However, if the speech signal corresponding to the segment is unvoiced, then the best matched segment is determined using the waveform criterion in step 1619 without the necessity of utilizing the pitch information.

If the segment and the best-matched segment are sufficiently correlated as determined in step 1621, then the two segments are overlapped and added in step 1625. However, if the two segments are not sufficiently correlated, the segment is not overlapped and added with the best-matched segment in step 1623. Step 1627 determines if the frame has been completely processed. If so, the enhanced speech signal corresponding to the frame is outputted to a speech coder in step 1629 in order to be appropriately processed in accordance with the associated algorithm of the speech coder. If the frame is not completely processed, then the buffer pointer is repositioned to the segment position in step 1631.

It is to be understood that the above-described embodiment is merely an illustrative principle of the invention and that many variations may be devised by those skilled in the art without departing from the scope of the invention. It is, therefore, intended that such variations be included with the scope of the claims.

We claim:

1. A method for enhancing speech intelligibility of a speech signal, comprising:

performing syllable segmentation on a frame of the speech signal in order to detect a syllable;

dynamically determining a scaling factor for a segment of speech in response to performing syllable segmentation on a frame of the speech signal in order to detect a syllable, wherein the segment is contained in the frame;

applying the scaling factor to the segment in order to modify a time scaling to the segment; and blending the segment with an overlapping segment in order to essentially retain a frequency attribute of the speech signal that is processed, wherein:

the syllable is a time-scale modification syllable (TSMS) comprising a consonant-vowel transition and a steady-state vowel, and dynamically determining a scaling factor for a segment of speech comprises:

setting the scaling factor to a first value, wherein time expansion occurs during the consonant-vowel transition; and setting the scaling factor to a second value, wherein time compression occurs during the steady-state vowel.

2. The method of claim 1, wherein:

the time expansion occurs during an approximate first one third of the TSMS, and the time compression occurs during an approximate next two thirds of the TSMS.

3. The method of claim 1, where dynamically determining a scale factor for a segment of speech further comprises:

setting the scaling factor to a third value, wherein time compression occurs during low energy regions of the speech signal.

4. The method of claim 3, wherein a time duration of the speech signal is essentially equal to a time duration of the processed speech signal.

5. The method of claim 1, further comprising:

modifying frequency domain characteristics of the speech signal in order that a transformed speech signal is characterized by enhanced acoustic cues.

6. The method of claim 5, wherein modifying frequency domain characteristics of the speech signal comprises:

adaptive spectral enhancing the speech signal, wherein a distinctness of spectral peaks of the speech signal is increased.

7. The method of claim 6, wherein modifying frequency domain characteristics of the speech signal further comprises:

emphasizing higher frequencies of the speech signal, wherein an upward spread of masking of the speech signal is reduced.

8. The method of claim 1, wherein blending the segment with an overlapping segment utilizes an algorithmic technique selected from the group consisting of an overlap-add (OLA) technique and a waveform similarity overlap-add (WSOLA) technique.

9. The method of claim 1, wherein blending the segment with an overlapping segment comprises:

adding the overlapping segment with the segment if a correlation between the two segments is greater than a threshold; and essentially retaining the segment if the correlation between the two segments is less than the threshold.

10. The method of claim 1, wherein performing syllable segmentation on a frame of the speech signal comprises:

detecting a high energy region of the speech signal.

11. The method of claim 1, wherein performing syllable segmentation on a frame of the speech signal comprises:

detecting abrupt changes in frequency-domain characteristics of the speech signal.

12. The method of claim 1, wherein performing syllable segmentation on a frame of the speech signal comprises:

utilizing cross-correlation measures.

13. The method of claim 1, further comprising:

amplifying a first portion of the TSMS in order to partially restore an associated energy in response to applying the scaling factor to the segment.

14. The method of claim 1, further comprising:

determining a time delay associated with the segment; and adjusting the scaling factor of a subsequent segment if the time delay is greater than a threshold in response to applying the scaling factor to the segment.

15. The method of claim 1, wherein the frequency attribute is a short-term Fourier Transform (STFT) of the speech signal.

16. The method of claim 1, further comprising:

outputting a processed speech signal to a telecommunications network in response to blending the segment with an overlapping segment.

17. The method of claim 1, further comprising:

estimating a pitch component of the speech signal;

utilizing information about the pitch component when blending the segment with an overlapping segment in response to estimating a pitch component of the speech signal; and outputting a processed signal to a speech coder in response to utilizing information about the pitch component.

18. The method of claim 17, wherein the speech coder is selected from the group consisting of a code excited linear predication (CELP) coder, a vector sum excitation prediction (VSELP) coder, a waveform interpolation (WI) coder, a multiband excitation (MBE) coder, an improved multiband excitation (IMBE) coder, a mixed excitation linear prediction (MELP) coder, a linear prediction coding (LPC) coder, a pulse code modulation (PCM) coder, a differential pulse code modulation (DPCM) coder, and an adaptive differential pulse code modulation (ADPCM) coder.

19. The method of claim 1, further comprising:

outputting a processed speech signal to a speech coder in response to blending the segment with an overlapping segment.

20. A method for enhancing an intelligibility of a speech signal comprising:

adaptive spectral enhancing the speech signal, wherein a distinctness of spectral peaks of the speech signal is increased;

emphasizing higher frequencies of the speech signal, wherein an upward spread of masking of the speech signal is reduced;

extracting a frame from the speech signal;

calculating an energy contour and a spectral feature transition rate (SFTR) contour corresponding to the frame;

performing syllable segmentation utilizing the energy contour and the SFTR contour in order to detect a time-scale modification syllable (TSMS);

applying a scaling factor to a segment of speech, wherein the segment corresponds to a portion of the frame, comprising:

setting the scaling factor to a first value when a consonant-vowel transition is detected within the TSMS, time expansion occurring during the consonant-vowel transition;

setting the scaling factor to a second value when a steady-state vowel is detected with the TSMS, time compression occurring during the steady-state vowel; and setting the scaling value to a third value for other portions of the speech signal;

determining an overlapping segment that is best-matched to the segment according to a cross-correlation and waveform similarity criterion;

calculating a time delay associated with the segment;

adjusting the scaling factor associated with a subsequent segment according to the calculated time delay;

overlapping and adding the segment and the overlapping segment; and outputting a modified frame in response to processing all constituent segments of the frame.

21. A method for enhancing an intelligibility of a speech signal comprising:

extracting a frame from the speech signal;

calculating an energy contour and a spectral feature transition rate (SFTR) contour corresponding to the frame;

performing syllable segmentation utilizing the energy contour and the SFTR contour in order to detect a time-scale modification syllable (TSMS);

applying a scaling factor to a segment of speech, wherein the segment corresponds to a portion of the frame, comprising:

setting the scaling factor to a first value when a consonant-vowel transition is detected within the TSMS, time expansion occurring during the consonant-vowel transition;

setting the scaling factor to a second value when a steady-state vowel is detected with the TSMS, time compression occurring during the steady-state vowel; and setting the scaling value to a third value for other portions of the speech signal;

determining an overlapping segment that is best-matched to the segment according to a cross-correlation and waveform similarity criterion;

calculating a time delay associated with the segment;

adjusting the scaling factor associated with a subsequent segment according to the calculated time delay;

overlapping and adding the segment and the overlapping segment; and outputting a modified frame in response to processing all constituent segments of the frame.

22. A method for enhancing an intelligibility of a speech signal that is processed by a speech coder, comprising:

extracting a frame from the speech signal;

performing syllable segmentation in order to detect a time-scale modification syllable (TSMS);

applying a scaling factor to a segment, wherein the frame comprises at least one segment, comprising:

setting the scaling factor to a first value when a consonant-vowel transition within the TSMS is detected, time expansion occurring during the consonant-vowel transition;

setting the scaling factor to a second value when a steady-state vowel within the TSMS is detected, time compression occurring during the steady-state vowel; and setting the scaling factor to a third value for other portions of the frame;

estimating a pitch component of the frame;

determining an overlapping segment that is best-matched to the segment according to a cross correlation and waveform similarity criterion, and to the speech component if the frame has a voiced characteristic;

combining the segment with an adjacent segment, comprising:

overlapping and adding the segment and the overlapping segment if a correlation between the segment and the overlapping segment is greater than a threshold; and essentially retaining the segment if the correlation between the segment and the overlapping segment is less than the threshold; and outputting a modified frame to the speech coder in response to processing all constituent segments of the frame.

23. A method comprising:

performing syllable segmentation on a frame of the speech signal in order to detect a syllable;

dynamically determining a scaling factor for a segment of speech in response to performing syllable segmentation on a frame of the speech signal in order to detect a syllable, wherein the segment is contained in the frame;

applying the scaling factor to the segment in order to modify a time scaling to the segment; and blending the segment with an overlapping segment in order to essentially retain a frequency attribute of the speech signal that is processed, wherein:

performing syllable segmentation on a frame of the speech signal in order to detect a syllable comprises detecting abrupt changes in frequency domain characteristics of the speech signal.

24. The method of claim 23, wherein dynamically determining a scaling factor for a segment of speech comprises:

setting the scaling factor to a first value, wherein time expansion occurs during an approximate first one third of the TSMS; and setting the scaling factor to a second value, wherein time compression occurs during an approximate next two thirds of the TSMS.

25. The method of claim 23, wherein dynamically determining a scaling factor for a segment of speech comprises:

setting the scaling factor to a first value, wherein time expansion occurs during the consonant-vowel transition; and setting the scaling factor to a second value, wherein time compression occurs during the steady-state vowel.

* * * * *